US008563488B2

(12) United States Patent
Sivik et al.

(10) Patent No.: US 8,563,488 B2
(45) Date of Patent: Oct. 22, 2013

(54) FUNCTIONALIZED POLYMER COMPOSITION FOR GREASE

(75) Inventors: Matthew R. Sivik, Broadview Hts., OH (US); Richard A. Denis, Auburn Township, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 792 days.

(21) Appl. No.: 10/806,591

(22) Filed: Mar. 23, 2004

(65) Prior Publication Data

US 2005/0215442 A1 Sep. 29, 2005

(51) Int. Cl.
*C10M 129/42* (2006.01)
*C10M 159/24* (2006.01)

(52) U.S. Cl.
USPC ..... 508/460; 508/391

(58) Field of Classification Search
USPC ..... 508/460, 560, 574, 391
See application file for complete search history.

(56) References Cited

U.S. PATENT DOCUMENTS

| | | | | | |
|---|---|---|---|---|---|
| 3,461,108 | A | | 8/1969 | Heilmann et al. | 260/78.5 |
| 3,560,455 | A | | 2/1971 | Hazen et al. | 260/78.5 |
| 3,560,456 | A | | 2/1971 | Hazen et al. | 260/78.5 |
| 3,729,451 | A | | 4/1973 | Blecke et al. | 260/78.5 |
| 4,560,489 | A | | 12/1985 | Muir et al. | 252/33.4 |
| 4,597,880 | A | | 7/1986 | Eliades | 252/33.4 |
| 4,670,173 | A | * | 6/1987 | Hayashi et al. | 508/233 |
| 4,966,722 | A | * | 10/1990 | Smith, Jr. | 508/506 |
| 5,244,957 | A | * | 9/1993 | Best et al. | 524/418 |
| 5,308,514 | A | | 5/1994 | Olson et al. | 252/18 |
| 5,338,467 | A | | 8/1994 | Olson et al. | 252/33.4 |
| 5,830,832 | A | * | 11/1998 | Benda et al. | 508/460 |
| 5,932,525 | A | * | 8/1999 | Ney et al. | 508/287 |
| 6,063,742 | A | * | 5/2000 | Konzman | 508/368 |
| 6,239,083 | B1 | * | 5/2001 | Muir | 508/393 |
| 6,300,288 | B1 | | 10/2001 | Scharf et al. | 508/221 |
| 6,676,733 | B2 | * | 1/2004 | Ludwig et al. | 106/2 |
| 2003/0000866 | A1 | * | 1/2003 | Cain | 208/18 |
| 2003/0176298 | A1 | | 9/2003 | Nakatani et al. | |

FOREIGN PATENT DOCUMENTS

WO WO 2004/111163 12/2004

OTHER PUBLICATIONS

Corresponding PCT Search Report for International Application No. PCT/US2005/008687; date of mailing of search report: Jul. 11, 2005.
"Ashless Rust Inhibitors for Greases", (Maureen E. Hunter, Syed Q.A. Rizvi, Robert F. Baker, King Industries, Norwalk, CT, presented at 67th National Lubricating Grease Institute Annual Meeting Oct. 28-Nov. 1, 2000).
ASTM Designation D 217-02 "Standard Test Methods for Cone Penetration of Lubricating Grease", (ASTM International, West Conshohocken, PA, 2002).

* cited by examiner

*Primary Examiner* — Jim Goloboy
(74) *Attorney, Agent, or Firm* — Michael F. Esposito; Teresan W. Gilbert

(57) ABSTRACT

A grease composition containing: (a) the reaction product of: (i) a calcium containing overbased organic acid; and (ii) at least one acid producing compound or derivatives thereof selected from the group consisting of: (1) a non-polymeric hydrocarbyl substituted dicarbonyl derivative selected from the group consisting of an acid, an ester, a salt, an anhydride, ester-acid, acid-salt and mixtures thereof; (2) a copolymer derived from monomers containing (1) an olefin; and (2) an unsaturated dicarboxylic acid anhydride or derivatives thereof; and (3) an inorganic acid containing about 2 or more acidic hydrogens; and (b) an oil of lubricating viscosity, wherein the overbased calcium sulphonate contains colloidally dispersed calcium carbonate is selected from the group consisting of calcite, vaterite and mixtures thereof. The invention further relates to the process to make the composition and its use in greases to increase water resistance.

5 Claims, No Drawings

FUNCTIONALIZED POLYMER COMPOSITION FOR GREASE

FIELD OF THE INVENTION

The present invention relates to grease, in particular a lubricating grease composition comprising: (a) the reaction product of (i) an overbased containing calcium overbased organic acid; (ii) a compound containing an acid producing group or derivatives thereof; and (b) an oil of lubricating viscosity, wherein the overbased organic acid contains colloidally dispersed calcium carbonate selected from the group consisting of calcite, vaterite and mixtures thereof. The invention further relates to the process to make the grease composition and its use.

BACKGROUND OF THE INVENTION

It is known to prepare greases from base oil, an overbased calcium sulphonate thickener as well as conventional thickener such as lithium 12-hydroxy stearate and optionally other performance additives for example antioxidants or antiwear agents. Grease containing an overbased calcium sulphonate thickener is known to have acceptable corrosion inhibiting properties. However, this type of grease has poor water resistance properties such as poor water wash-off or water repellency as shown in an ASTM D4049 water spray-off test. Grease with poor water wash-off or water repellency decreases the longevity of grease and increases wear on the surface being lubricated.

Polymers have also been added to grease, other than overbased calcium sulphonate grease, to improve the performance characteristics of the grease. For example, polymers have been employed to decrease water wash-off, to decrease oil separation, to increase water repellency, to increase dropping points or cone penetration and as thickeners. The polymers are polymethacrylates or polyolefins. Typically these polymers are incorporated in the base oil and act as a viscosity modifier. However, the polymers have limited interaction with the thickener resulting in the grease being more susceptible to the effects of water, for example, water wash-off or decreased water repellency.

U.S. Pat. No. 5,308,514 (Olson et al.) discloses a high performance overbased calcium sulphonate, grease comprising up to about 28 wt % of overbased calcium sulphonate, colloidally dispersed in the calcium carbonate essentially in the form of calcite, a calcium soap of a fatty acid containing about 12 to about 24 carbon atoms and an oleaginous material. The grease has a worked cone penetration rating of less than about 295. The grease contains a polymer with poor water resistance properties.

U.S. Pat. No. 5,338,467 (Olson et al.) discloses a process for preparing a non-Newtonian oil composition in the form of a grease comprising an overbased calcium sulphonate, colloidally dispersed in calcium carbonate in the form of calcite. The grease is prepared by heating the overbased calcium sulphonate amorphous calcium carbonate and a converting agent containing about 12 to about 24 carbon atoms in an oleaginous material. Neither the process nor the final grease contains a polymer capable of imparting water resistance properties.

U.S. Pat. No. 4,597,880 (Eliades et al.) discloses a one-step process for preparing a calcium sulphonate grease or complex grease by admixing a volatile carrier, calcium sulphonate as a dispersing agent and calcium carbonate in the form of calcite. Neither the process nor the final grease contains a polymer capable of imparting water resistance properties.

U.S. Pat. No. 6,300,288 (Scharf et al.) discloses a polyolefin having grafted carboxylic acid functionality capable of imparting water resistance properties into grease. The grease may contain a gelled overbased material containing a number of acidic organic compounds with functional groups including sulphonic acid hydrocarbyl succinic acid or ester thereof, or a carboxylic acid or derivatives thereof. The carboxylic acid includes polyisobutylene succinic acid or polypropene succinic acid.

It would be desirable to have a grease capable of imparting decreased water wash-off. The present invention provides a grease that is capable of imparting decreased water wash-off.

It would be desirable to have a grease that is capable of imparting improved thickening. The present invention provides a grease that is capable of imparting improved thickening.

SUMMARY OF THE INVENTION

The present invention provides a grease in particular a lubricating grease composition comprising:

(a) the reaction product of:

(i) a calcium containing overbased organic acid; and (ii) at least one acid producing compound or derivatives thereof selected from the group consisting of:

(1) a non-polymeric hydrocarbyl substituted dicarbonyl derivative selected from the group consisting of an acid, an ester, a salt, an anhydride, ester-acid, acid-salt and mixtures thereof;

(2) a copolymer derived from monomers comprising (1) an olefin; and (2) an unsaturated dicarboxylic acid anhydride or derivatives thereof; and (3) an inorganic acid containing about 2 or more acidic hydrogens; and (b) an oil of lubricating viscosity, wherein the calcium containing overbased organic acid contains colloidally dispersed calcium carbonate selected from the group consisting of calcite, vaterite and mixtures thereof.

The present invention provides a process for preparing a grease composition comprising:

(1) mixing (a) an overbased calcium sulphonate; (b) at least one acid producing compound or derivatives thereof selected from the group consisting of: (i) a non-polymeric hydrocarbyl substituted dicarbonyl derivative selected from the group consisting of an acid, an ester, a salt, an anhydride, ester-acid, acid-salt and mixtures thereof; (ii) a copolymer derived from monomers comprising (1) an olefin; and (2) an unsaturated dicarboxylic acid anhydride or derivatives thereof; and (iii) an inorganic acid containing about 2 or more acidic hydrogens;

(2) adding an aqueous solvent to the overbased mixture of step (1) to form a solvated overbased mixture;

(3) heating the a solvated overbased mixture of step (2) to form a solvated colloidal mixture that contains colloidally dispersed calcium carbonate selected from the group consisting of calcite, vaterite and mixtures thereof;

(4) removing the aqueous solvent from the solvated colloidal mixture of step (3) to form colloidal mixture; and (5) optionally adding to the colloidal mixture of step (4) other performance additives selected from the group consisting of antioxidants, rust inhibitors, metal deactivators, antiwear agents, antiscuffing agents, extreme pressure agents, foam inhibitors, demulsifiers, friction modifiers, viscosity modifiers, pour point depressants and mixtures thereof to form a grease composition.

The invention further provides a grease composition containing polymers capable of improving thickening. The invention further provides a grease composition containing polymers capable of decreasing wear and increasing longevity.

DETAILED DESCRIPTION OF THE INVENTION

The present invention provides a grease in particular a lubricating grease composition comprising:

(a) the reaction product of:

(i) a calcium containing overbased organic acid; and (ii) at least one acid producing compound or derivatives thereof selected from the group consisting of:

(1) a non-polymeric hydrocarbyl substituted dicarbonyl derivative selected from the group consisting of an acid, an ester, a salt, an anhydride, ester-acid, acid-salt and mixtures thereof;

(2) a copolymer derived from monomers comprising (1) an olefin; and (2) an unsaturated dicarboxylic acid anhydride or derivatives thereof; and (3) an inorganic acid containing about 2 or more acidic hydrogens; and (b) an oil of lubricating viscosity, wherein the calcium containing overbased organic acid contains colloidally dispersed calcium carbonate selected from the group consisting of calcite, vaterite and mixtures thereof.

Overbased Materials

Overbased materials are known materials. Overbasing also referred to as superbasing or hyperbasing, is a means for supplying a large quantity of basic material in a form which is soluble or dispersible in oil. Overbased products are known and used in lubricant technology to provide detergent additives.

Overbased materials are generally single phase, homogeneous systems characterised by a metal content in excess of that which would be present according to the stoichiometry of the metal and the particular acidic organic compound reacted with the metal. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts may have a metal ratio of 1.5 to 30, preferably 3 to 25, and more preferably 7 to 20.

Overbased materials are prepared by reacting an acidic material, normally an acidic gas such as $SO_2$, $CO_2$ and the like, and most commonly carbon dioxide, with a mixture comprising an acidic organic compound, a reaction medium normally comprising an oil of lubricating viscosity, a stoichiometric excess of a metal base, and preferably a promoter.

Overbased Organic Acid

As used herein any reference to an overbased organic acid is intended to include the acid-producing derivatives thereof such as anhydrides, hydrocarbyl esters, acyl halides, lactones or mixtures thereof unless otherwise specifically stated.

The organic acid of the overbased organic acid includes a carboxylic acid, a sulphonic acid, a thiosulphonic acid, a phosphorus-containing acid, a phenol or mixtures thereof. Preferably the overbased organic acid is a carboxylic acid, a sulphonic acid or mixtures thereof.

The overbased organic acid may contain an acidic hydrogen, provided the acidic hydrogen is present in less than 50%, preferably less than 30%, more preferably less than 20%, even more preferably less than 10% and even more preferably less than 5% of available acid groups.

The organic acid suitable for making overbased organic acid salts include a saturated or unsaturated cyclic acid, acyclic acid or mixtures thereof. The organic acid includes a monocarboxylic acid, polycarboxylic acid or mixtures thereof. The organic acid contains 2 or more, preferably 4 or more, more preferably 6 or more and most preferably 8 or more carbon atoms. When the organic acid is a polycarboxylic acid, the number of acid groups is in the range of about 2 to about 20, preferably about 2 to about 10, more preferably about 2 to about 8 and most preferably about 2 to about 6.

Preferably the organic acid is soluble in an oil of lubricating viscosity and contains about 8 to about 400, preferably about 8 to about 100, more preferably about 10 to about 50 and most preferably about 10 to about 30 carbon atoms.

Examples of a suitable carboxylic acid include dodecanoic acid, decanoic acid, tall oil acid, 10-methyl-tetradecanoic acid, 3-ethyl-hexadecanoic acid, and 8-methyl-octadecanoic acid, palmitic acid, stearic acid, myristic acid, oleic acid, linoleic acid, behenic acid, hexatriacontanoic acid, tetrapropylenyl-substituted glutaric acid, polybutenyl-substituted succinic acid derived from a polybutene, polypropenyl-substituted succinic acid derived from a polypropene, octadecyl-substituted adipic acid, chlorostearic acid, 12-hydroxystearic acid, 9-methylstearic acid, dichlorostearic acid, ricinoleic acid, lesquerellic acid, stearylbenzoic acid, eicosanyl-substituted naphthoic acid, dilauryl-decahydronaphthalene carboxylic acid, 2-propylheptanoic acid, 2-butyloctanoic acid or mixtures thereof. Preferably the carboxylic acid is dodecanoic acid, decanoic acid, tall oil acid, 10-methyl-tetradecanoic acid, 3-ethyl-hexadecanoic acid, and 8-methyl-octadecanoic acid, palmitic acid, stearic acid, myristic acid, oleic acid, linoleic acid, behenic acid or mixtures thereof.

Carboxylic acid derivatives are also suitable for the invention and include alkali metal salts, alkaline earth metal salts, ammonium salts, anhydrides, esters, triglycerides or mixtures thereof. Examples of suitable alkali metal salts include lithium, potassium, sodium or mixtures thereof. Examples of suitable alkaline metal salts include calcium, barium, magnesium or mixtures thereof.

The overbased organic acid further includes an organic compound containing a sulphur reactive group. Examples of a suitable overbased organic acid containing sulphur include sulphonic acid, thiosulphonic acid or mixtures thereof. The sulphonic acid includes a mono-nuclear aromatic sulphonic acid, a poly-nuclear aromatic sulphonic acid, a mono-nuclear aromatic thiosulphonic acid, a poly-nuclear aromatic thiosulphonic acid, a hydrocarbyl substituted cyclic sulphonic acid, a hydrocarbyl substituted cyclic thiosulphonic acid, an aliphatic sulphonic acid, an aliphatic thiosulphonic acid or mixtures thereof.

The hydrocarbyl substituted cyclic thiosulphonic acid and/or hydrocarbyl substituted cyclic sulphonic acid includes a cyclic group such as indenyl, indanyl, bicyclopentadienyl or mixtures thereof.

Examples of a suitable mono-nuclear aromatic and/or a poly nuclear aromatic group include benzene, naphthalene, anthracene, diphenylene oxide, diphenylene sulphide, petroleum naphthenes or mixtures thereof. The mono-nuclear aromatic and/or poly nuclear aromatic group contains less than or equal to about 4, preferably less than or equal to about 3, more preferably less than or equal to about 2 and most preferably 1 sulphonic acid group and/or thiosulphonic acid group. The mono-nuclear aromatic and/or poly nuclear aromatic group contains less than or equal to about 4, preferably less than or equal to about 3, more preferably less than or equal to about 2 and most preferably 1 hydrocarbyl group.

The hydrocarbyl group may contain about 6 to about 50, preferably about 6 to about 40, more preferably about 8 to about 30 and most preferably about 8 to about 24 carbon atoms. The carbon atoms may be bonded together in such a manner to form moieties that are saturated, unsaturated, branched, linear, cyclic or mixtures thereof. Examples of a suitable hydrocarbyl group include alkyl, alkenyl, alkoxyalkyl, carboalkoxyalkyl or mixtures thereof.

Examples of suitable sulphonic acid include polypropene benzene sulphonic acid, undecyl benzene sulphonic acid, dodecyl benzene sulphonic acid, tridecyl benzene sulphonic acid, tetradecyl benzene sulphonic acid, pentadecyl benzene sulphonic acid, hexadecyl benzene sulphonic acid or mixtures thereof. Preferably the sulphonic acid includes undecyl benzene sulphonic acid, dodecyl benzene sulphonic acid, tridecyl benzene sulphonic acid, tetradecyl benzene sulphonic acid, octadecyl benzene sulphonic acid, tetraeicosyl benzene sulphonic acid or mixtures thereof. In one embodiment of the invention the sulphonic acid is a polypropene benzene sulphonic acid derived from about 18 to about 30 carbon atoms.

Optionally the mono-nuclear aromatic and/or a poly nuclear aromatic group includes inorganic or organic substituents in addition to those enumerated above, for example, a hydroxy, a mercapto, a halogen such as chlorine; bromine; iodine; fluorine or mixtures thereof, a nitro, an amino, a nitroso, a sulphide, a disulphide or mixtures thereof.

In one embodiment the organic acid is an aliphatic sulphonic acid, an aliphatic thiosulphonic acid or mixtures thereof. The aliphatic moiety includes a carbon linear chain, branched chain or mixtures thereof, although linear is preferred. Suitable groups include derivatives of a carboxylic acid containing about 7 to about 30, preferably about 7 to about 20, more preferably about 8 to about 20 and even more preferably about 8 to about 15 carbon atoms. Further the chain may be saturated or unsaturated, although saturated is preferred.

The overbased organic acid further includes an organic compound containing a phosphorus reactive group. When the overbased organic acid is a phosphorus-containing acid examples include phosphorus acid, thiophosphorus acid, mono-thiophosphorus acid, dithiophosphorus acid or mixtures thereof. The phosphorus-containing acid further includes esters, partial ester or mixtures thereof. The phosphorus-containing acid contains one hydrocarbyl group and preferably two hydrocarbyl groups containing from 1 to about 50 carbon atoms.

The overbased organic acid may have a TBN (total base number) of at least about 50, preferably at least about 80, more preferably at least about 100, even more preferably at least about 200 and most preferably at least about 300. In one embodiment the overbased organic acid has a TBN of about 400.

The overbased organic acid is may be present from about 5 to about 80, preferably about 10 to about 70, more preferably about 15 to about 55 and most preferably about 15 to about 45 weight percent of the grease composition.

The invention further includes acid producing compound or derivatives thereof. The acid producing compound or derivatives thereof may be present from about 0.001 to about 25, preferably about 0.01 to about 15, more preferably about 0.05 to about 10 and most preferably about 0.1 to about 6 weight percent of the grease composition.

Non-Polymeric Hydrocarbyl Substituted Dicarbonyl Derivative

As used herein, the term "non-polymeric" is used to describe a hydrocarbyl substituted dicarbonyl derivative that has not been copolymerised with itself or another monomer.

The present invention includes a non-polymeric hydrocarbyl substituted dicarbonyl derivative selected from the group consisting of an acid, an ester, a salt, an anhydride, ester-acid, acid-salt and mixtures thereof. The non-polymeric hydrocarbyl substituted dicarbonyl derivative includes compounds derived from the formulae:

(I)

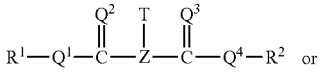

or (II)

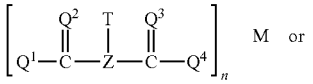

M or (III)

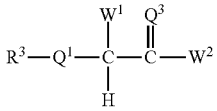

wherein T is a hydrogen, a hydrocarbyl group or mixtures thereof;

Z is 1 to about 20, preferably 1 to about 10, more preferably about 2 to about 8 and most preferably about 2 to about 4 carbon atoms;

$Q^1$, $Q^2$, $Q^3$, $Q^4$ and $Q^5$ are all independently oxygen or sulphur, preferably at least 1, more preferably at least 2, even more preferably at least 3 and most preferably all of $Q^1$, $Q^2$, $Q^3$, $Q^4$ and $Q^5$ are oxygen;

$R^1$, $R^2$, $R^3$ and $R^4$ are independently hydrogen or a hydrocarbyl group;

$W^1$ is $Q^5$-$R^4$;

$W^2$ is a hydrogen, $Q^4$-$R^2$ or mixtures thereof;

M is a valence of a metal ion, an ammonium ion or mixtures thereof; and n is an integer equal to or less than the available valence of M. When n is an integer less than the available valence of M, $Q^1$ or $Q^4$ independently is an ester, an acid or mixtures thereof as defined by $R^1$ or $R^2$ in formula (I).

Preferably T is a hydrocarbyl group containing about 4 to about 80, preferably 4 to about 40, more preferably about 6 to about 30, even more preferably about 6 to about 20 and most preferably about 8 to about 20 carbon atoms. The hydrocarbyl group includes alkyl, oxyalkyl, cycloalkyl, aryl or mixtures thereof, although alkyl, oxyalkyl or mixtures thereof are preferred. T may be branched or linear, although linear is preferred.

Examples of suitable a hydrocarbyl group for T include butyl, sec-butyl, isobutyl, tert-butyl, pentyl, n-hexyl, sec-hexyl, n-octyl, 2-ethylhexyl, nonyl, decyl, undecyl, dodecyl, tridecyl, tetradecyl, pentadecyl, hexadecyl, heptadecyl, octadecyl, octadecenyl, nonodecyl, eicosyl, iso-nonyl, iso-decyl, iso-undecyl, iso-dodecyl, iso-tridecyl, iso-tetradecyl, iso-pentadecyl, iso-hexadecyl, iso-heptadecyl, iso-octadecyl, iso-octadecenyl, iso-nonodecyl, iso-eicosyl or mixtures thereof. Preferably T includes nonyl, decyl, undecyl, dodecyl, tridecyl, tetradecyl, pentadecyl, hexadecyl, heptadecyl, octadecyl, octadecenyl, nonodecyl or mixtures thereof.

$R^1$, $R^2$, $R^3$ and $R^4$ are independently hydrogen or a hydrocarbyl group. When a hydrocarbyl group is present, preferably the hydrocarbyl group is alkyl, cycloalkyl, aryl or mixtures thereof. In one embodiment the hydrocarbyl group is alkyl or mixtures thereof. When the hydrocarbyl group is alkyl, alkyl chains may be branched or linear, although linear is preferred.

$R^1$ and $R^2$ may contain 1 to about 50, preferably about 2 to about 40, more preferably about 3 to about 30, and most preferably about 3 to about 20 carbon atoms. In one embodiment $R^1$ is hydrogen and $R^2$ is hydrocarbyl, and in another embodiment $R^1$ and $R^2$ are both hydrocarbyl groups.

Examples of a suitable hydrocarbyl group for $R^1$ and $R^2$ independently include propyl, iso-propyl, butyl, sec-butyl, isobutyl, tert-butyl, pentyl, n-hexyl, sec-hexyl, n-octyl, 2-ethylhexyl, nonyl, decyl, undecyl, dodecyl, tridecyl, tetradecyl, pentadecyl, hexadecyl, heptadecyl, octadecyl, octadecenyl, nonodecyl, eicosyl, iso-nonyl, iso-decyl, iso-undecyl, iso-dodecyl, iso-tridecyl, iso-tetradecyl, iso-pentadecyl, iso-hexadecyl or mixtures thereof. Preferably and $R^2$ independently include propyl, iso-propyl, butyl, sec-butyl, isobutyl, tert-butyl, pentyl, n-hexyl, sec-hexyl, n-octyl, 2-ethylhexyl, nonyl, decyl, undecyl, dodecyl, tridecyl, tetradecyl or mixtures thereof.

$R^3$ may contain 1 to about 20, preferably about 1 to about 15, more preferably about 1 to about 10, and most preferably about 1 to about 5 carbon atoms. Examples of a suitable hydrocarbyl group for $R^3$ include methyl, ethyl, propyl, iso-propyl, butyl, sec-butyl, isobutyl, tert-butyl, pentyl or mixtures thereof. Preferably $R^3$ includes methyl, ethyl or mixtures thereof.

$R^4$ may contain 1 to about 30, preferably about 2 to about 20, more preferably about 2 to about 15, and most preferably about 2 to about 10 carbon atoms. Examples of a suitable hydrocarbyl group for $R^4$ include ethyl, propyl, iso-propyl, butyl, sec-butyl, isobutyl, tert-butyl, pentyl, n-hexyl, sec-hexyl, n-octyl, 2-ethylhexyl, nonyl, decyl, undecyl, dodecyl or mixtures thereof. Preferred examples of a suitable hydrocarbyl group for $R^4$ include ethyl, propyl, iso-propyl, butyl, sec-butyl, isobutyl, tert-butyl, pentyl, n-hexyl, sec-hexyl, n-octyl, 2-ethylhexyl, nonyl, decyl or mixtures thereof.

The carbon atoms defined by Z include linear, branched or mixtures thereof. Optionally Z includes inorganic or organic substituents, for example, a hydroxy, a mercapto, a halogen such as chlorine; bromine; iodine; fluorine or mixtures thereof, a nitro, an amino, a nitroso, a sulphide, a disulphide or mixtures thereof.

When M is a valence of a metal ion, the metal may be monovalent, divalent, trivalent or mixtures thereof. When monovalent, the metal M may be an alkali metal, preferably lithium, sodium, or potassium; and more preferably potassium. When divalent, the metal M may be an alkaline earth metal, preferably magnesium, calcium, barium or mixtures of such metals, more preferably calcium. When trivalent, the metal M may be aluminium. In one embodiment the metal is an alkaline earth metal and preferably calcium. The valence of metal ion may be used alone or in combination.

Examples of a non-polymeric hydrocarbyl substituted dicarbonyl derivative include nonyl adipic acid, decyl adipic acid, dodecyl adipic acid, tetradecyl adipic acid, hexadecyl adipic acid, octadecyl adipic acid, octadecenyl adipic acid, nonodecyl adipic acid, nonyl 3,3-dimethyl pentanedioic acid, decyl 3,3-dimethyl pentanedioic acid, undecyl 3,3-dimethyl pentanedioic acid, dodecyl 3,3-dimethyl pentanedioic acid, tridecyl 3,3-dimethyl pentanedioic acid, tetradecyl 3,3-dimethyl pentanedioic acid, pentadecyl 3,3-dimethyl pentanedioic acid, hexadecyl 3,3-dimethyl pentanedioic acid, heptadecyl 3,3-dimethyl pentanedioic acid, octadecyl 3,3-dimethyl pentanedioic acid, octadecenyl 3,3-dimethyl pentanedioic acid, nonodecyl 3,3-dimethyl pentanedioic acid, nonyl succinic acid, decyl succinic acid, undecyl succinic acid, dodecyl succinic acid, tridecyl succinic acid, tetradecyl succinic acid, pentadecyl succinic acid, hexadecyl succinic acid, heptadecyl succinic acid, octadecyl succinic acid, octadecenyl succinic acid, nonodecyl succinic acid, nonyl glutaric acid, decyl glutaric acid, undecyl glutaric acid, dodecyl glutaric acid, tridecyl glutaric acid, tetradecyl glutaric acid, pentadecyl glutaric acid, hexadecyl glutaric acid, heptadecyl glutaric acid, octadecyl glutaric acid, octadecenyl glutaric acid, nonodecyl glutaric acid, the reaction product of an olefin and a glyoxylic acid or derivatives thereof such as an ester, a hemiacetal including mono-methyl ester hemiacetal of glyoxylic acid, mono-ethyl ester hemiacetal of glyoxylic acid, mono-propyl ester hemiacetal of glyoxylic acid, mono-butyl ester hemiacetal of glyoxylic acid, or mixtures thereof.

Most preferred examples of non-polymeric hydrocarbyl substituted dicarbonyl derivative include nonyl succinic acid, decyl succinic acid, undecyl succinic acid, dodecyl succinic acid, tridecyl succinic acid, tetradecyl succinic acid, pentadecyl succinic acid, hexadecyl succinic acid, heptadecyl succinic acid, octadecyl succinic acid, octadecenyl succinic acid, nonodecyl succinic acid, the reaction product of an olefin and glyoxylic acid or derivatives thereof such as an ester, a hemiacetal including mono-methyl ester hemiacetal of glyoxylic acid, mono-ethyl ester hemiacetal of glyoxylic acid, mono-propyl ester hemiacetal of glyoxylic acid, mono-butyl ester hemiacetal of glyoxylic acid or mixtures thereof.

Examples of a non-polymeric hydrocarbyl substituted dicarbonyl derivative include an ester of glutaric, succinic, adipic, malonic or 3,3-dimethyl pentanedioic acids listed above. The ester formed is a monoester, a diester or mixtures thereof of said acids.

Examples of a non-polymeric hydrocarbyl substituted dicarbonyl derivative include a salt with a valence of a metal ion, an ammonium ion or mixtures thereof of the metals listed above. Preferably the metal is calcium.

Alternatively, the non-polymeric hydrocarbyl substituted dicarbonyl derivative includes tartaric acid, citric acid, tartaric acid, muccic acid, citramalic acid, citric acid, isopropylmalic acid, gluconic acid, malic acid, oxalic acid, succinic acid, glutaric acid, adipic acid, pimelic acid, suberic acid, azelaic acid, sebacic acid, 1,11-undecanedicarboxylic acid, 1,12-dodecanedicarboxylic acid or mixtures thereof. In one embodiment the non-polymeric hydrocarbyl substituted dicarbonyl derivative is tartaric acid. In one embodiment the non-polymeric hydrocarbyl substituted dicarbonyl derivative is citric acid.

Olefin Copolymer

The copolymer suitable for the invention includes those derived from monomers comprising (1) an olefin; and (2) an unsaturated dicarboxylic acid anhydride or derivatives thereof may be present from about 0.001 to about 25, preferably about 0.01 to about 15, more preferably about 0.05 to about 10 and most preferably about 0.1 to about 6 weight percent of the grease composition.

The olefin may contain about 6 to about 40, preferably about 10 to about 34, more preferably about 12 to about 30 and most preferably about 14 to about 22 carbon atoms. Examples of a suitable olefin include 1-undecene, 1-dodecene, 1-tridecene, 1-butadecene, 1-pentadecene, 1-hexadecene, 1-heptadecene 1-octadecene, 1-nonadecene, 1-eicosene, 1-doeicosene, 2-tetracosene, 3-methyl-1-henicosene, 4-ethyl-2-tetracosene or mixtures thereof. Preferred examples of a suitable olefin include 1-pentadecene, 1-hexadecene, 1-heptadecene 1-octadecene, 1-nonadecene or mixtures thereof.

The unsaturated dicarboxylic acid anhydride or derivatives thereof includes a maleic anhydride represented by the formula (IV) or derivatives thereof:

(IV)

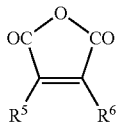

wherein $R^5$ and $R^6$ are independently hydrogen or a hydrocarbyl group containing about 1 to about 40, preferably about 1 to about 30, more preferably about 1 to about 20 and most preferably about 1 to about 10 carbon atoms. The carbon atoms of the hydrocarbyl group may be alkyl, alkylaryl, cycloalkyl, aryl or mixtures thereof. The hydrocarbyl group may be substituted, unsubstituted, branched, unbranched or mixtures thereof, although, unsubstituted is preferred. Derivatives of the maleic structure shown in formula (IV) include an acid, an ester, a salt, an anhydride, ester-acid, acid-salt or mixtures thereof.

Suitable salt derivatives of formula (IV) include a metal such as an alkali metal, an alkaline earth metal or mixtures thereof. Preferably salt derivatives of formula (IV) include a metal such as lithium, sodium, potassium, magnesium, calcium or mixtures thereof.

Suitable examples of the unsaturated dicarboxylic acid anhydride or derivatives thereof functionality suitable for the compositions include maleic anhydride, methyl maleic anhydride, ethyl maleic anhydride, dimethyl maleic anhydride or mixtures thereof. A preferred unsaturated dicarboxylic acid anhydride or derivatives thereof functionality is maleic anhydride and may be used alone or in combination.

Inorganic Acid

When present the inorganic acid containing about 2 or more acidic hydrogens includes phosphoric acid, sulphuric acid or mixtures thereof. Preferably the inorganic acid containing about 2 or more acid hydorgens is a phosphoric acid or mixtures thereof.

When present, the an inorganic acid containing about 2 or more acidic hydrogens may be present from about 0.001 to about 25, preferably about 0.01 to about 15, more preferably about 0.05 to about 10 and most preferably about 0.1 to about 6 weight percent of the grease composition.

Oil of Lubricating Viscosity

The lubricating oil composition includes natural or synthetic oils of lubricating viscosity, oil derived from hydrocracking, hydrogenation, hydrofinishing, unrefined, refined and re-refined oils and mixtures thereof.

Natural oils include animal oils, vegetable oils, mineral oils or mixtures thereof. Synthetic oils include a hydrocarbon oil, a silicon-based oil, a liquid esters of phosphorus-containing acid. Synthetic oils may be produced by Fischer-Tropsch reactions and typically may be hydroisomerised Fischer-Tropsch hydrocarbons or waxes.

Oils of lubricating viscosity may also be defined as specified in the American Petroleum Institute (API) Base Oil Interchangeability Guidelines. In one embodiment the oil of lubricating viscosity comprises an API Group I, II, III, IV, V or mixtures thereof, and preferably API Group I, II, III or mixtures thereof. If the oil of lubricating viscosity is an API Group II, III, IV or V oil there may be up to about 40 wt % and most preferably up to a maximum of about 5 wt % of the lubricating oil an API Group I oil.

The oil of lubricating viscosity may be present from about 0.01 to about 95, preferably from about 0.1 to about 89.9, even more preferably about 0.5 to about 84.9 and most preferably from about 1 to about 83.8 weight percent of the grease composition. The oil of lubricating viscosity may be used alone or in combination.

Functionalised Polymer

Optionally the invention further includes a functionalised polymer containing an unsaturated dicarboxylic acid anhydride or derivatives thereof. The functionalised polymer containing an unsaturated dicarboxylic acid anhydride or derivatives thereof may be used alone or in combination. The functionalised polymer includes:

(a) a grafted functionalised polyolefin;

(b) an esterified polymer derived from monomers comprising: (i) a vinyl aromatic monomer; (ii) an unsaturated dicarboxylic acid anhydride or derivatives thereof, disclosed in more detail in US Application by Sivik, M. and Twining S., The Lubrizol Corporation filed on Mar. 19, 2004 Ser. No. 10/805,055 and is hereby incorporated by reference;

(c) a polymer derived from monomers comprising: (i) at least one unsaturated α,β-carboxylic acid ester containing an alkyl group having about 10 to about 20 carbon atoms; (ii) at least one unsaturated α,β-carboxylic acid ester containing an alkyl group having about 4 to about 11 carbon atoms different from monomer (i); and (iii) at least one unsaturated dicarboxylic acid anhydride or derivatives thereof; and (d) a hydrolysed or un-hydrolysed maleic anhydride-styrene-oxyalkylene copolymer.

The optional functionalised polymer containing an unsaturated dicarboxylic acid anhydride or derivatives thereof may be present from of 0 to about 25, preferably about 0.01 to about 20, more preferably about 0.05 to about 15 and most preferably about 0.08 to about 10 weight percent of the grease composition.

In one embodiment the functionalised polymer is a polyolefin that is grafted with an unsaturated dicarboxylic acid anhydride or derivatives thereof. The polyolefin is essentially composed of olefin monomers, and preferably alpha-olefin monomers. The polyolefin preferably contains an ethylene monomer and at least one other comonomer derived from an alpha-olefin having the formula $H_2C{=}CHR^7$, wherein $R^7$ is a hydrocarbyl group, preferably an alkyl radical containing 1 to about 18, preferably 1 to about 10, more preferably 1 to about 6 and most preferably 1 to about 3 carbon atoms. The hydrocarbyl group includes an alkyl radical that has a straight chain, a branched chain or mixtures thereof. The polyolefin is preferably free of an ethylene homopolymer and has a degree of crystallinity when the polymer is functionalised with an unsaturated dicarboxylic acid anhydride or derivatives thereof.

Examples of suitable a comonomer include propylene, butene-1, hexene-1, octene-1, 4-methylpentene-1, decene-1, dodecene-1, tridecene-1, tetradecene-1, pentadecene-1, hexadecene-1, heptadecene-1, octadecene-1, nonadecene-1 or mixtures thereof. Preferably the comonomer is butene-1, propylene or mixtures thereof. Exemplary examples of the polyolefin include ethylene-propylene copolymers, ethylenebutene-1 copolymers or mixtures thereof. Preferred polymers are copolymers of ethylene and propylene and ethylene and butene-1.

The functionalised polymer is formed by grafting the polyolefin with the unsaturated dicarboxylic acid anhydride or derivatives thereof to form the functionalised polymer. The preparation of polyolefin polymers are known in the art.

Optional Thickening Agent

Optionally the invention further comprises a thickening agent such as metal salts of carboxylic acids other than those of component (b) are known in the art of grease formulation.

In one embodiment the grease composition is free of thickening agent. In one embodiment the grease composition contains thickening agent.

The carboxylic acid used in the thickener include a fatty acid and may be a mono- or poly-hydroxycarboxylic acid. The carboxylic acid has about 4 to about 30, preferably about 8 to about 27, more preferably about 19 to about 24 and most preferably about 10 to about 20 carbon atoms. Examples of suitable fatty acids include capric acid, palmitic acid, stearic acid, oleic acid or mixtures thereof.

In one embodiment the carboxylic acid thickener may be a hydroxy-substituted fatty acid or mixtures thereof. A preferred hydroxy-substituted fatty acid is hydroxy stearic acid, wherein one or more hydroxy groups may be located at positions 10-, 12- or 14- on the alkyl group. Suitable examples include 10-hydroxystearic acid, 12-hydroxystearic acid, 14-hydroxystearic acid or mixtures thereof. In one embodiment the hydroxy-substituted fatty acid is 12-hydroxystearic acid.

The thickener may also be prepared directly from at least one fatty acid source, such as vegetable oil or animal fats, by saponification. The thickener may be prepared directly from a fatty acid and may be hydrogenated castor oil, glyceride or other esters containing alkyl groups. The alkyl groups may contain 1 to about 10, preferably 1 to about 5 and most preferably 1 to about 3 carbon atoms. Suitable examples of alkyl groups for the fatty acid esters include methyl, ethyl, propyl, butyl, pentyl, glycerol and mixtures thereof.

In one embodiment the thickening agents may be inorganic powders selected from the group consisting of clay, organoclays, bentonite, fumed silica, carbon black, pigments, copper phthalocyanine or mixtures thereof. In one embodiment the calcite containing thickeners made from overbased calcium sulphonate or carboxylates may be used.

The metal may be an alkali metal, alkaline metal, aluminium or mixtures thereof. Examples of suitable metals include lithium, potassium, sodium, calcium, magnesium, barium, aluminium or mixtures thereof. Preferably the metal is lithium, calcium, aluminium or mixtures thereof.

The thickener is present in the range from 0 to about 20, preferably from 0 to about 15, even more preferably 0 to about 10 and most preferably from 0 to about 5 weight percent of the grease composition. The thickener may be used alone or in combination.

Other Performance Additives

Optionally, the composition include at least one other performance additive include antioxidants, rust inhibitors, metal deactivators, antiwear agents, antiscuffing agents, extreme pressure agents, foam inhibitors, demulsifiers, friction modifiers, viscosity modifiers, detergents, pour point depressants and mixtures thereof. The other performance additives may be used alone or in combination.

The other performance additives may be present from 0 to about 20, preferably from 0 to about 15, even more preferably 0 to about 10 and most preferably from 0 to about 5 weight percent of the grease composition. Although one or more of the other performance additives may be present, it is common for the performance additives to be present in different amounts relative to each other.

Other performance additives such as rust inhibitors including octylamine octanoate, condensation products of dodecenyl succinic acid or anhydride and a fatty acid such as oleic acid with a polyamine; metal deactivators including derivatives of benzotriazoles, 1,2,4-triazoles, benzimidazoles, 2-alkyldithiobenzimidazoles or 2-alkyldithiobenzothiazoles; foam inhibitors including poly ethyl acrylate, poly 2-ethylhexylacrylate and poly vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides; antioxidants including diphenylamines, sterically hindered phenols, molybdenum dithiocarbamates or sulphurised olefins; and detergents including a phenate, a sulphonate, a carboxylic acid, a phosphorus acid, a mono- and/or a di-thiophosphoric acid, a saligenin, an alkylsalicylate or a salixarate; may also be used in the composition of the invention.

Additionally the invention may also include other performance additives imparting wear inhibition including antiwear agents such as metal thiophosphates, especially zinc dialkyldithiophosphates; phosphoric acid esters or salt thereof; phosphites; and phosphorus-containing carboxylic esters, ethers, and amides; antiscuffing agents including organic sulphides and polysulphides, such as benzyldisulphide, bis-(chlorobenzyl) disulphide, dibutyl tetrasulphide, di-tertiary butyl polysulphide, di-tert-butylsulphide, sulphurised Diels-Alder adducts or alkyl sulphenyl N'N-dialkyl dithiocarbamates; Extreme Pressure (EP) agents including chlorinated wax, organic sulphides and polysulphides, such as benzyldisulphide, bis-(chlorobenzyl) disulphide, dibutyl tetrasulphide, sulphurised sperm oil, sulphurised methyl ester of oleic acid, sulphurised alkylphenol, sulphurised dipentene, sulphurised terpene, and sulphurised Diels-Alder adducts; phosphosulphurised hydrocarbons, metal thiocarbamates, such as zinc dioctyldithiocarbamate and barium heptylphenol diacid; may also be used in the composition of the invention.

Additionally the invention may also include friction modifiers including fatty amines, esters such as borated glycerol esters, fatty phosphites, fatty acid amides, fatty epoxides, borated fatty epoxides, alkoxylated fatty amines, borated alkoxylated fatty amines, metal salts of fatty acids, fatty imidazolines, condensation products of carboxylic acids and polyalkylene-polyamines, amine salts of alkylphosphoric acids; viscosity modifiers including copolymers of styrene-butadiene rubbers, ethylene-propylene, polyisobutenes, hydrogenated styrene-isoprene polymers, hydrogenated isoprene polymers, polymethacrylate acid esters, polyacrylate acid esters, polyalkyl styrenes, alkenyl aryl conjugated diene copolymers, polyolefins, polyalkylmethacrylates and esters of maleic anhydride-styrene copolymers; may also be used in the composition of the invention.

Process

The invention further provides a process to prepare a grease composition comprising the steps of:

(1) mixing (a) an overbased calcium sulphonate; (b) at least one acid producing compound or derivatives thereof selected from the group consisting of: (i) a non-polymeric hydrocarbyl substituted dicarbonyl derivative selected from the group consisting of an acid, an ester, a salt, an anhydride, ester-acid, acid-salt and mixtures thereof; (ii) a copolymer derived from monomers comprising (1) an olefin; and (2) an unsaturated dicarboxylic acid anhydride or derivatives thereof; (iii) an inorganic acid containing about 2 or more acidic hydrogens; and (c) an oil of lubricating viscosity to form an overbased mixture;

(2) adding an aqueous solvent to the overbased mixture of step (1) to form a solvated overbased mixture;

(3) heating the solvated overbased mixture of step (2) to a temperature in the range of about 60° C. to about 250° C.; preferably about 110° C. to about 210° C. and most preferably about 125° C. to about 190° C.; at pressures in the range about 650 mm of Hg (about 86.7 kPa) to about 2000 mm of Hg (about 266.6 kPa), preferably about 690 mm of Hg (about 92 kPa) to about 1500 mm of Hg (about 200 kPa), and most preferably about 715 mm of Hg (about 95 kPa) to about 1000 mm of Hg (about 133 kPa); and for a period of time in the range of about 2 minutes to about 24 hours, preferably about 10 minutes to about 18 hours and most preferably about 30 minutes to about 6 hours, to form a solvated colloidal mixture that contains colloidally dispersed calcium carbonate selected from the group consisting of calcite, vaterite and mixtures thereof;

(4) removing the aqueous solvent from the solvated colloidal mixture of step (3) to form colloidal mixture; and (5) optionally adding to the colloidal mixture of step (4) at least one other performance additive selected from the group consisting of antioxidants, rust inhibitors, metal deactivators, antiwear agents, antiscuffing agents, extreme pressure agents, foam inhibitors, demulsifiers, friction modifiers, viscosity modifiers, pour point depressants and mixtures thereof to form a grease composition.

In step (1), (a) (b) and (c) are mixed sequentially, separately, in combination or mixtures thereof; and may be added in a single portion, a multiple portion or mixtures thereof. Each portion is of approximately the same weight, different weight or mixtures thereof. Preferably when more than one portion is added each portion is approximately the same weight.

The invention optionally includes adding the functionalised polymer containing an dicarboxylic acid anhydride or derivatives thereof to the overbased mixture of step (1). In one embodiment of the invention the process further includes adding the functionalised polymer (a)(ii)(2) containing an dicarboxylic acid anhydride or derivatives thereof to the overbased mixture of step (1).

Step (1) and step (2) of the process are carried out at temperature in the range of about 25° C. to about 120° C.; preferably about 30° C. to about 100° C. and most preferably about 35° C. to about 80° C.; at pressures in the range about 650 mm of Hg (about 86.7 kPa) to about 2000 mm of Hg (about 266.6 kPa), preferably about 690 mm of Hg (about 92 kPa) to about 1500 mm of Hg (about 200 kPa), and most preferably about 715 mm of Hg (about 95 kPa) to about 1000 mm of Hg (about 133 kPa).

The solvents suitable for the invention include aliphatic solvents, aromatic solvents, alcohols, ethers, esters, an oil of lubricating viscosity and mixtures thereof. Examples of suitable the optional solvents include hexane, cyclohexane, heptane, mineral spirits, petroleum ether, benzene, toluene; isopropanol, iso-butanol, 2-ethylhexanol, diethyl ether, methyl tert-butyl ether, ethyl acetate, iso-amyl acetate or mixtures thereof.

When used as a solvent, the oil of lubricating viscosity may be the same or different to the oil of lubricating viscosity of the grease. Although the oil of lubricating viscosity may be used as a solvent, an aromatic solvent is preferred. In one embodiment the solvent is toluene or mixtures thereof. When present solvent, may be used alone or in combination.

Industrial Application

The use of grease composition of the present invention will impart to a grease at least one improved property including improved water repellence, improved water wash-off, improved thickening, increased longevity, decreased wear or mixtures thereof.

The following examples provide an illustration of the invention. It should however be noted that these examples are non exhaustive and not intended to limit the scope of the invention.

SPECIFIC EMBODIMENT

EXAMPLES

Preparative Example 1

Preparation of Copolymer of C18 Olefin and Maleic Anhydride

A 4-necked flask containing a stirrer, thermometer, an addition funnel and a nitrogen sparge tube is charged with about 1008 g of octadecene, about 52 g of maleic anhydride and about 1000 g of xylene. The addition funnel is charged with about 10 g of di-tert-butyl peroxide in about 50 g of xylene. The flask is heated to about 60° C. and nitrogen is bubbled through the reactants using the sparge tube while heating to about 100° C. An additional funnel containing about 471 g of melted maleic anhydride in about 100 g of xylene is added to the flask. The reaction mixture is then heated to about 135° C. where the di-tert-butyl peroxide is then added dropwise. To the reaction mixture melted maleic anhydride is added dropwise over a period of about 3 hours. The reaction mixture is stirred for about another 30 minutes to complete the polymerisation before heating the product to 190° C. to remove xylene. The product has a $\overline{M}_w$ of about 4756 and a $\overline{M}_n$ of about 1630.

Examples 1-7 and Reference Example R1

Example 1

Calcium Sulphonate Grease Containing Alkyl Succinic Acid

A resin flask with a volume of about 3 liters is fitted with a resin lid, a stainless steel stirrer, a stainless steel tube with a lead to a thermocouple, a gas adapter and a Dean Stark trap fitted with a condenser is charged with (i) about 590 g of a 400 TBN overbased calcium sulphonate; (ii) about 410 g of oil; and (iii) about 41.6 g of dodecenyl succinic acid in about 26.7 g of diluent oil. The mixture is heated for about 1 hour at about 60° C. About 300 g of 800 SUS oil is added and the temperature is increased to about 67° C. followed by the addition of about 80 g of water. After about 5 minutes the temperature decreases to about 61° C. when about 100 g of isopropyl alcohol added resulting in the temperature of the mixture decreasing to about 51° C. The mixture is heated to about 57° C. where it turns yellow. Increasing the temperature to about 60° C., results in the mixture becoming viscous. Under a nitrogen atmosphere, the mixture is heated to about 67° C. and about 305 g of 800 SUS oil is added. The mixture is slowly heated to about 158° C. and held at temperature for about 1 hour to form the calcium sulphonate grease. The calcium sulphonate is present at about 29 wt % of the grease composition. An ASTM D217 cone penetration test run established that Example 1 has a Po=263 tenths of millimeters (where Po is the cone penetration of an unworked grease).

Example 2

The calcium sulphonate grease is prepared using the process described in Example 1, except about 88 g of a solution of a copolymer derived from an olefin and an unsaturated dicarboxylic acid anhydride is added immediately after the addition of the 400 TBN overbased calcium sulphonate. The calcium sulphonate is present at about 28 wt % of the grease composition. An ASTM D217 penetration test run established that Example 2 has a Po=318 tenths of millimeters.

Example 3

The calcium sulphonate grease is prepared using the process described in Example 1, except about 495 g of 400 TBN overbased calcium sulphonate is added, about 358 g 800 SUS oil, about 65 g of dodecenyl succinic acid in about 20 g of diluent oil and about 3.4 g of phosphoric acid is added before the mixture is heated.

Example 4

Example 4 is prepared using the same apparatus as Example 1, except a solution consisting of about 35 g of hexadecenyl succinic anhydride, and about 6 g of water which is heated at 65° C. until the corresponding succinic acid is formed and about 27 g of azelaic acid dissolved in about 25 g of isopropyl alcohol by means of heating the contents to 85° C. The solutions are combined and added at room temperature to the resin flask which contains about 684 g of 400 TBN overbased calcium sulphonate and about 375 g of 800 SUS oil. The flask is heated to about 51° C. after which increments of 800 SUS oil are added. The contents of the flask are heated to 95° C. and then transferred to a Hobart kettle to finish processing to about 120° C. The product obtained has a Po=298 tenths of millimeters.

Example 5

Example 5 is prepared using the same apparatus as Example 1, but using about 45 g of the polymer prepared in Preparative Example 1, except the flask is charged with about 310 g of 800 SUS oil and about 290 g of 300 TBN overbased calcium sulphonate. The flask is heated to about 50° C. where about 48 g of a magnesium saligenin is added before heating the mixture to about 60° C. About 140 g more of 800 SUS oil is added whilst heating to about 77° C. The flask is then heated to about 160° C. to remove volatile matter. The product obtained as has a Po=296 tenths of millimeters.

Example 6

Example 6 is prepared using the same apparatus as Example 1. The flask is charged with about 580 g of 400 TBN overbased calcium sulphonate, about 420 g 800 SUS oil and heated to about 33° C. where about 54 g of melted azelaic acid in about 100 g of isopropyl alcohol is added to the flask over about 20 minutes. The flask is heated to about 57° C. where about 80 g of water and 10 g of isopropyl alcohol are separately added cooling the flask temperature to about 43° C. The flask is heated to about 52° C. and the mixture becomes viscous. To the flask about 390 g of 800 SUS oil is added. The temperature is then increased to about 66° C. before another 146 g addition of 800 SUS oil. The temperature is further increased to 74° C. before another 208 g addition of 800 SUS oil. After the addition of oil the temperature is increased 85° C. where another 130 g of 800 SUS oil is added. The contents of the flask are transferred to a Hobart kettle and mixed at about 130° C. to remove residual water. The product obtained as has a Po=293 tenths of millimeters.

Example 7

Example 7 is prepared using the same apparatus as Example 1. The flask is charged with about 628 g of 300 TBN overbased calcium sulphonate and about 615 g of 800 SUS oil and heated to about 48° C. The flask is then charged with a solution of about 34 g of citric acid in about 25 g $H_2O$. The flask is then heated to about 52° C. where about 20 g of water and about 60 g of methyl alcohol are separately added. The flask is then heated to about 60° C. before the addition of about 60 g of $H_2O$ and 100 g of isopropyl alcohol. The reaction is mixed for about 5 minutes and about 170 g of 800 SUS oil are added. The flask is heated to about 130° C. to remove solvent. The product is cooled. The product obtained as has a Po=316° C. tenths of millimeters.

Reference Example 1 (R1)

The calcium sulphonate grease is prepared using the process described in Example 1, except the dodecyl succinic acid is not added. The calcium sulphonate is present at about 38 wt % of the grease composition. An ASTM D217 penetration test run established that Reference Example 1 has a Po=296 tenths of millimeters.

Test 1

The ASTM D4049 test measures the resistance of grease to water spray. A pre-weighed stainless steel panel is evenly coated with about 8 mm of grease. The panel is then reweighed. The coated stainless steel panel is then placed in a water spray for about 5 minutes. The water is preheated to about 38° C. and held at constant temperature. The water pressure pump is held at about 276 kPa (equivalent to about 40 psi). The panel is removed from the spray and heated in an oven for about 1 hour at about 66° C. The panel is then removed from the oven, allowed to cool and is reweighed. The results obtained for the grease compositions are shown in Table 2 below.

TABLE 1

ASTM D4049 Results

| Example | % Grease Removed by Water Spray |
|---|---|
| 1 | 22.9 |
| 2 | 14.8 |
| R1 | 40 |

The results indicate calcium sulphonate grease from Example 1 and Example 2 has better resistance to water spray than the reference example not containing the alkyl succinic acid of the invention. Grease with better resistance to water spray have increased longevity and/or decreased wear.

While the invention has been explained, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A grease composition comprising:

(a) the reaction product of:

(i) a calcium containing overbased organic acid; and (ii) at least one acid producing compound or derivatives thereof comprising a non-polymeric hydrocarbyl substituted derivative of succinic acid, wherein the hydrocarbyl contains about 4 to about 40 carbon atoms; and (b) an oil of lubricating viscosity, wherein the calcium containing overbased organic acid contains colloidally dispersed calcium carbonate calcite.

2. The composition of claim 1, wherein the hydrocarbyl contains about 6 to about 20 carbon atoms.

3. The composition of claim 1, wherein the hydrocarbyl contains about 8 to about 20 carbon atoms.

4. The composition of claim 1, wherein the non-polymeric hydrocarbyl substituted derivative is nonyl succinic acid, decyl succinic acid, undecyl succinic acid, dodecyl succinic acid, tridecyl succinic acid, tetradecyl succinic acid, pentadecyl succinic acid, hexadecyl succinic acid, heptadecyl succinic acid, octadecyl succinic acid, octadecenyl succinic acid, nonadecyl succinic acid, or mixtures thereof.

5. The composition of claim 1 further comprising a thickening agent.

* * * * *